US005103745A

United States Patent [19]

Harloff

[11] Patent Number: 5,103,745

[45] Date of Patent: Apr. 14, 1992

[54] MOVABLE AIR SEALS FOR A ROTARY COMBUSTOR

[75] Inventor: Richard R. Harloff, Monroeville, Pa.

[73] Assignee: Westinghouse Electric Corp., Pittsburgh, Pa.

[21] Appl. No.: 762,808

[22] Filed: Sep. 20, 1991

Related U.S. Application Data

[63] Continuation of Ser. No. 660,367, Feb. 25, 1991, abandoned.

[51] Int. Cl.[5] ..... A47J 36/00; F24D 1/18

[52] U.S. Cl. ..... 110/246; 432/103; 432/116; 432/242

[58] Field of Search ..... 110/246; 432/103, 242, 432/116

[56] References Cited

U.S. PATENT DOCUMENTS

| | | | |
|---|---|---|---|
| 4,782,768 | 11/1988 | Lee et al. | 432/103 |
| 4,782,769 | 11/1988 | Lee et al. | 432/103 |
| 4,950,155 | 8/1990 | Brienza et al. | 432/115 |
| 4,951,580 | 8/1990 | Samera et al. | 432/246 |
| 4,972,786 | 11/1990 | Blasiole | 432/103 |

*Primary Examiner*—Henry C. Yuen
*Attorney, Agent, or Firm*—Fred J. Baehr, Jr.

[57] ABSTRACT

A movable axially oriented air seal for a rotary combustor for burning municipal solid waste wherein the shoe portion of the seal is movable allowing the area over which underfire and overfire air can be supplied to be varied to improve the efficiency of burning the waste irrespective of varying heat value and moisture content of the waste.

6 Claims, 3 Drawing Sheets

MOVABLE AIR SEALS FOR A ROTARY COMBUSTOR

This application is a continuation of application Ser. No. 07/660,367 filed Feb. 25, 1991, abandoned.

BACKGROUND OF THE INVENTION

The invention relates to a municipal solid waste incinerator and more particularly to movable air seals for the rotary combustor to vary the boundary between underfire and overfire combustion air.

Municipal solid waste varies substantially from one location to another so that optimizing the burning of the municipal solid waste at each location is difficult and changes in the amount of combustion air as underfire and overfire air together with varying the speed of rotation of the combustor have been utilized to provide the optimum burning. With changes of heating value and moisture the burning efficiency of the waste within the rotary combustor is not optimized. Good axial seals as described in U.S. Pat. No. 4,950,155 improve the burning efficiency; however, the boundaries within which overfire and underfire air is supplied remains the same, not allowing the degree of control necessary to obtain the best burning conditions for the particular waste being burned.

SUMMARY OF THE INVENTION

Among the objects of the invention may be noted the ability to improve the combustion control in the burning zones of the rotary combustor to efficiently burn waste having varying heating values and moisture content.

In general, a circumferentially movable axially oriented air seal, when made in accordance with this invention, is disposed adjacent an area of a rotary combustor in which waste is burned and comprises a plurality of spaced apart axially oriented thin seal strips extending generally outwardly from the outer periphery of the rotary combustor; an arcuate shoe spanning at least the space between two adjacent seal strips so that at least one seal strip is always in contact with said shoe; a duct for supplying combustion air to the rotary combustor via perforated webs. The duct is divided into an underfire portion and an overfire portion. The shoe and the attaching structural elements cooperate so that the shoe can be positioned at various locations relative, to the rotary combustor and the position of burning waste in the rotary combustor and maintain a seal in order to improve the efficiency of the burning of the waste within the combustor irrespective to the heating value of the waste or its moisture content.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
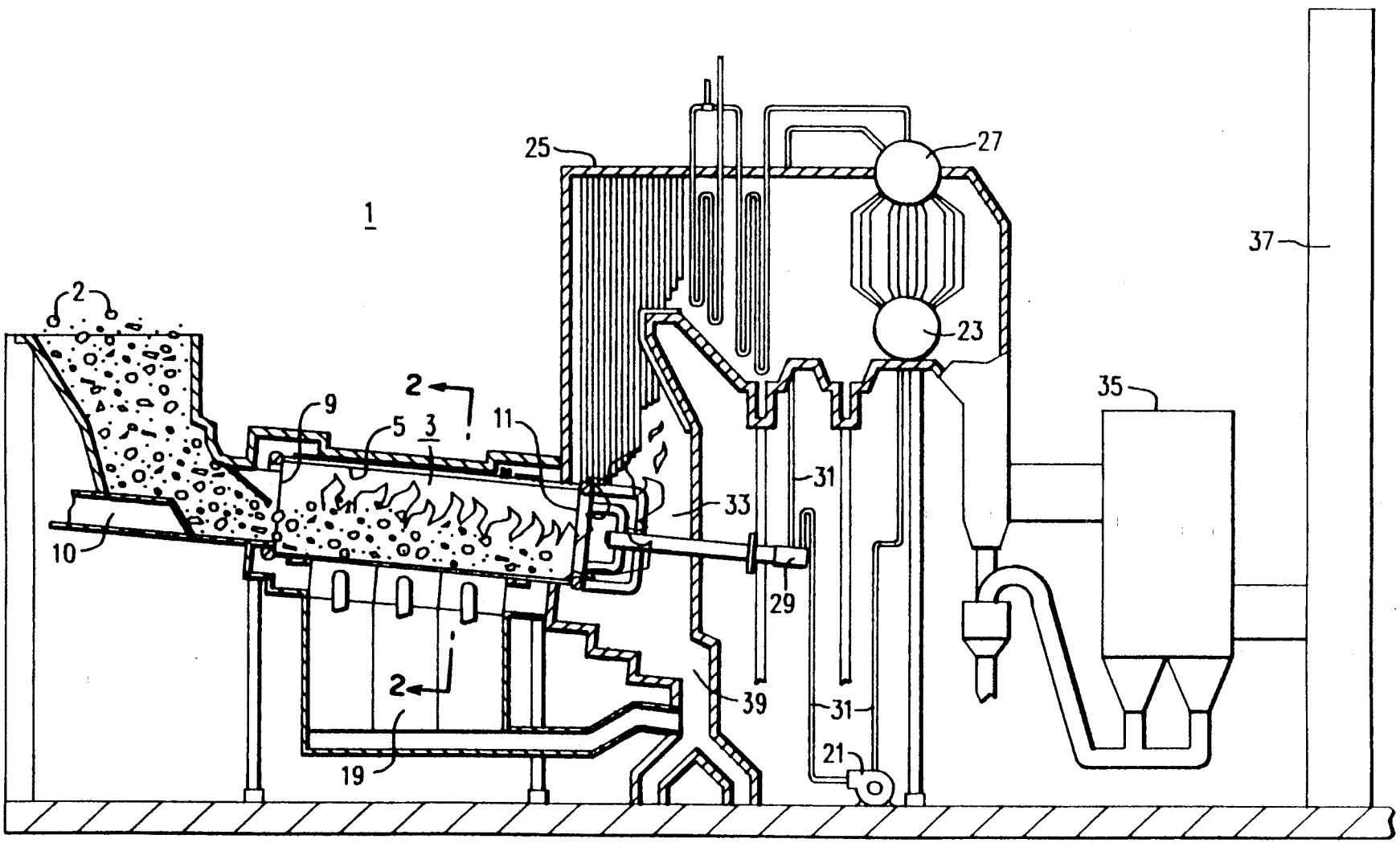
FIG. 1 is a schematic partial sectional view of a municipal solid waste disposal plant.

Referring now to the drawings in detail, and in particular to FIG. 1, there is shown an incinerator 1 for burning municipal solid waste 2 in a rotary combustor 3. The rotary combustor 3 is formed from a cylindrical array of axially oriented spaced apart tubes or pipes 5 with a perforated plate or web 7 connecting adjacent pipes 5. The rotary combustor 3 is disposed to rotate on an inclined axis. Waste 2 to be incinerated is fed into an upper or inlet end 9 of the combustor 3 by a ram 10 and tumbles toward a lower or outlet end 11 as the combustor 3 rotates on metal tires, which engage spaced apart rollers (not shown). The plates or webs 7 are perforated to provide holes or perforations 15 which allow combustion air supplied from plenum chambers 17 and 19 to enter the rotary combustor 3. The burning tumbling waste 2 tends to ride up on one side of the combustor 3 as it rotates and the plenum chamber 17 thereunder is disposed to supply combustion air to the underside of the burning waste and is thus called the underfire plenum chamber 17, and the adjacent plenum chamber 19 is disposed to supply combustion air over the burning waste and is thus called the overfire plenum chamber 19.

A cooling fluid, water, is circulated through the pipes 5 to keep them and the webs 7 cool and increase their useful life. The water is supplied from a pump 21, which takes its suction from a water drum 23 in a waste heat water wall boiler 25 and returns the heated cooling fluid to a steam drum 27 via a rotary joint 29 and associated piping 31. Unburnables, ash and hot gases exit from the lower end 11 of the combustor 3, the hot gases and some fly ash flow upwardly in a flue portion 33 of the boiler 25, through a filter 35 such as a electrostatic precipitator or other filtering means, which remove the ash, and out a stack 37. The heavier ash and unburnables fall into an ash removal hopper 39 in the bottom portion of the boiler 25.

To provide efficient burning of the waste irrespective of its varying heat and moisture content, the underfire and overfire combustion air are controlled separately, thus requiring that a dependable movable axial or longitudinal seals 41 be disposed at the junctures of the plenum chambers 17 and 19 and the rotary combustor 3 and shown in FIGS. 2, 3, 4, and 5.

Figure 3:
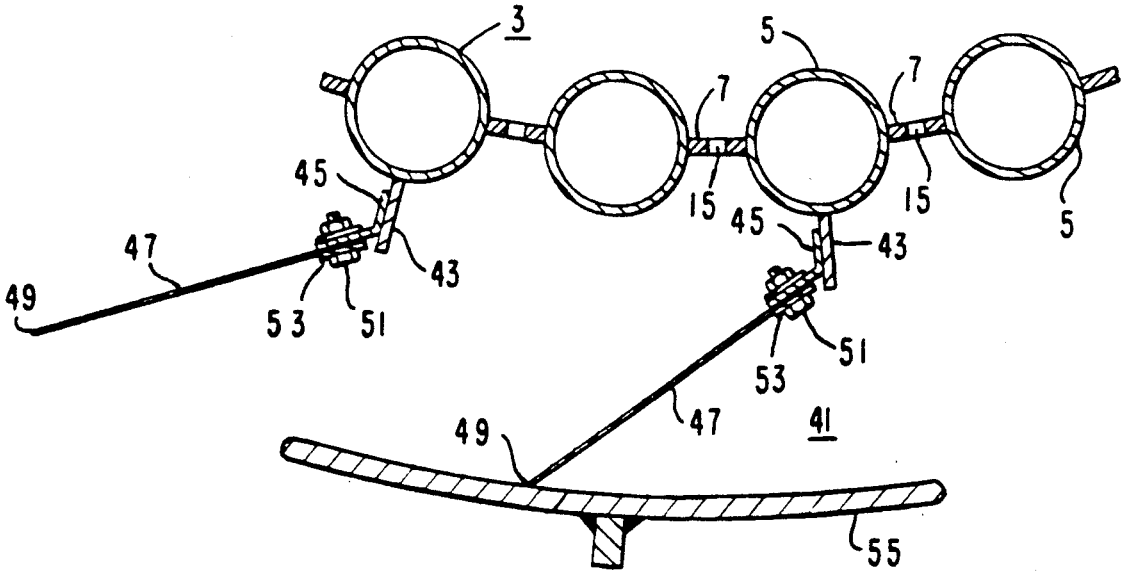
FIGS. 3 and 4 are partial sectional views of portions of FIG. 2 with the portions enlarged out of scale in order to show the invention.

As shown best in FIG. 3, the movable longitudinal seal 41 comprises a flat plate or bar 43 affixed longitudinally along the length of at least some of the pipes 5 so as to extend radially outward therefrom. An angle bracket 45 is affixed to the flat plate 43 by welding or other means. The bracket 45 is positioned on the flat plate 43 and moved radially inwardly or radially outwardly prior to welding to compensate for out of roundness of the rotary combustor 3. A thin strip 47 made of stainless steel or other resilient heat resistant material is replaceably fastened to the angle bracket 45 so that a distal margin 49 thereof extends from the angle bracket 45 and away from said rotary combustor 3 and forms and included angle of approximately 60° with respect to the flat plate 43. Bolts and nuts or other removable fasteners 51 and a backing bar 53 are utilized to fasten the thin strip 47 to the backing bar 45 so that it can be replaced relatively easily.

Figure 2:
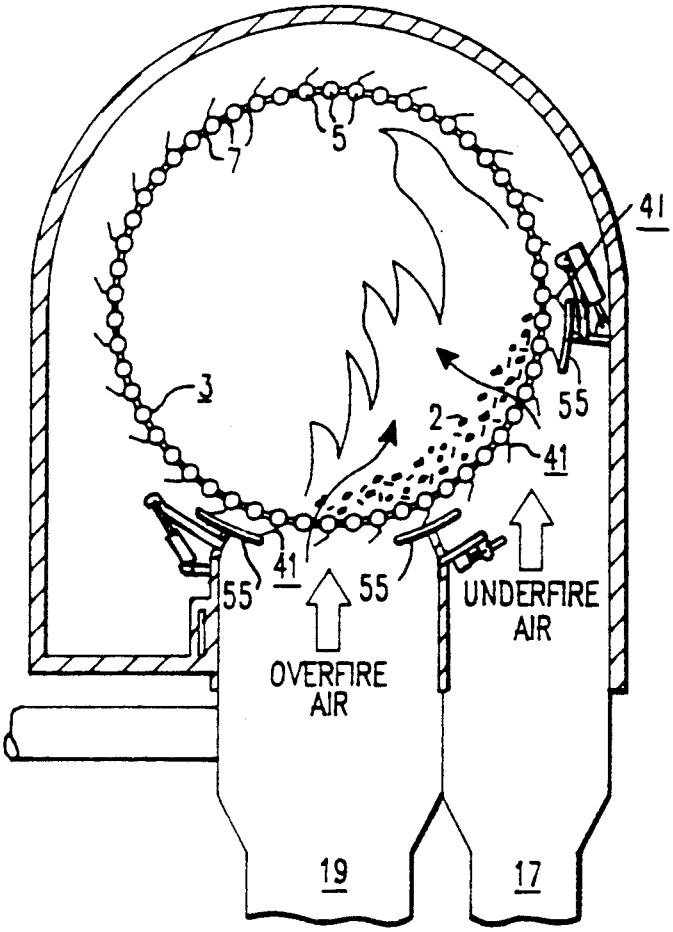
FIG. 2 is a partial sectional view taken on line A—A of FIG. 1.
Figure 4:
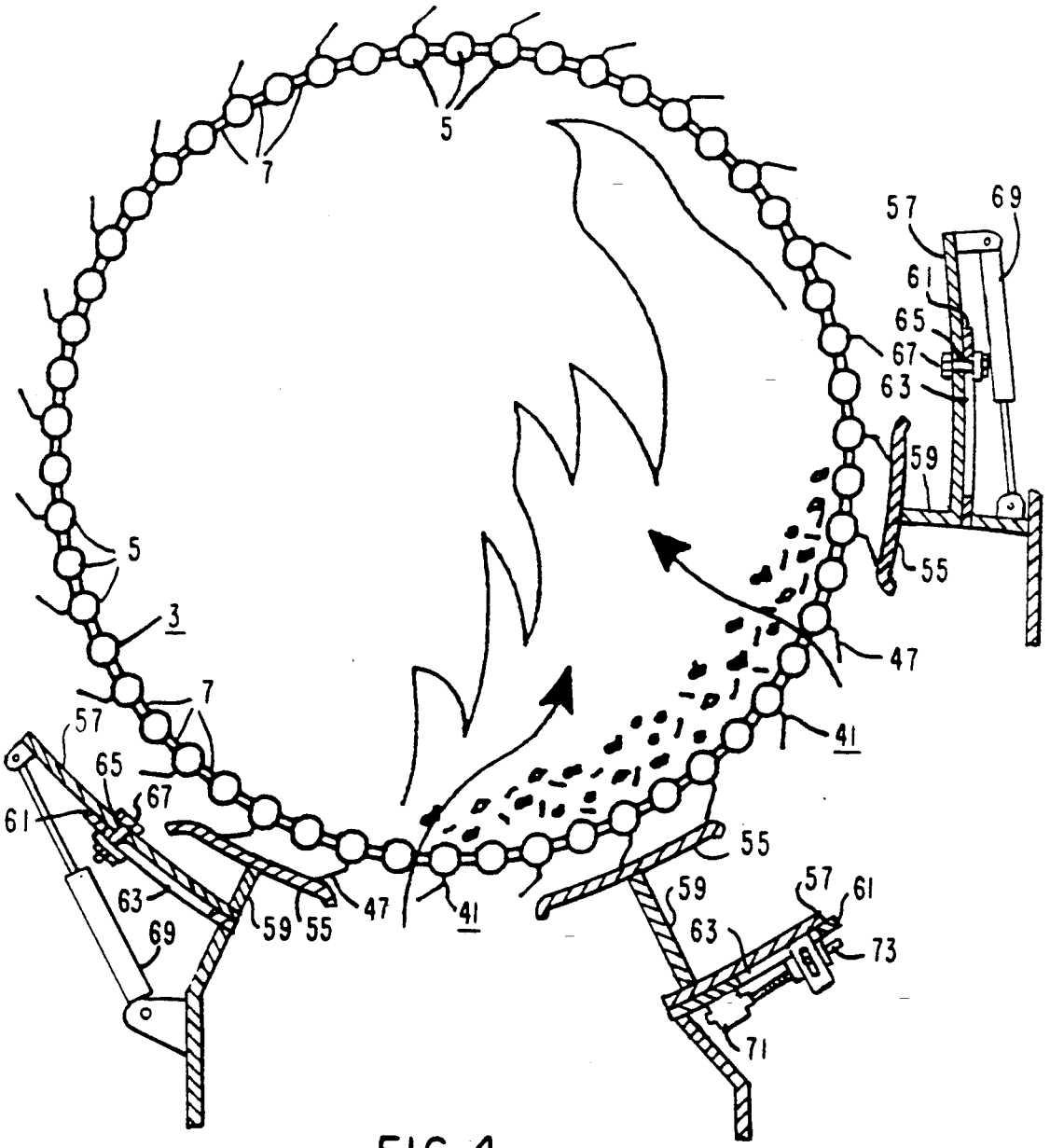
Figure 5:
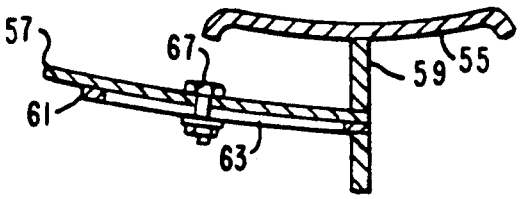
FIG. 5 is an enlarged partial sectional view of an alternative embodiment.

As shown in FIGS. 2 and 4, an arcuate shoe 55 spanning at least the space between two adjacent seal strips 47 is so disposed that at least one seal strip 47 is always in contact with the shoe 55. An arcuate plate 57 generally the length of the shoe 55 and a support plate 59 generally the length of the shoe 55 are disposed to position the shoe 55 radially inwardly from the arcuate plate 57 and generally a fixed distance from the outer periphery of the rotary combustor 3. The support plate 59 is disposed adjacent a longitudinal margin of the arcuate plate 57 and is oriented radially with respect to the rotary combustor 3. A second arcuate plate 61 registers with the first-mentioned arcuate plate 57 and is fixed adjacent the rotary combustor 3. The first and second arcuate plates 57 and 61 are cooperatively associated to allow the first arcuate plate 57 to move along an arcuate path generally a fixed distance from the outer periphery of the rotary combustor 3. In the embodiments shown, the first and second arcuate plates 57 and 61 have a plurality of slots 63 oriented with the arc in one arcuate plate and a plurality of holes 65, which register with the slots 63 in the other arcuate plate. Fastener such as bolts, nuts and washers or other fastener means 67 keep the arcuate plates 57 and 61 together. The fastening means 67 can be loosened to position the shoe 55 at various positions along the arc and then tightened to fix the shoe 55 in its new position, as shown in FIG. 5. The fasteners 67 can also be made just loose enough to allow the arcuate plates 57 and 61 to slide with respect to each other and the first arcuate plate 57 can be positioned remotely utilizing a fluid actuated cylinder 69 or an electric motor 71 and drive screw 73 or other actuating device as shown in FIGS. 2 and 4.

Moving the position of the shoes 55 can substantially change the area over which either the underfire or overfire air is fed into the combustor 3 and alter the burning rate to control the efficiency of the burning process and the amount of CO being produced and thus compensate for large differences in the moisture content or heating value of the waste providing better control of the burning process.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A circumferentially movable axially oriented air seal disposed adjacent an area of a rotary combustor in which waste is burned; the rotary combustor being formed by a cylindrical array of axially oriented cooling tubes spaced apart by a plurality of perforated webs; said movable air seal comprising a plurality of spaced apart axially oriented thin seal strips extending generally outwardly from the outer periphery of the rotary combustor, an axially elongated arcuate shoe spanning at least the space between two adjacent seal strips so that at least one seal strip is always in contact with said arcuate shoe, a duct for supplying combustion air to the rotary combustor via the perforated webs, means for dividing the duct into an underfire portion and an overfire portion, means for moving said axially oriented arcuate shoe circumferentially relative to an adjacent axially oriented shoe to vary the area over which underfire and overfire air is fed into the combustor in order to improve the efficiency of the burning of the waste within the combustor.

2. The circumferentially movable air seal of claim 1, wherein the means for moving the arcuate shoe comprises a first arcuate plate generally the length of the arcuate shoe, a support plate generally the length of the arcuate shoe disposed to position the arcuate shoe radially inwardly from the first arcuate plate, and a second arcuate plate which registers with the first arcuate plate and which is fixed adjacent the rotary combustor; the first and second arcuate plates being cooperatively associated so as to allow the first arcuate plate to move along an arcuate path generally a fixed distance from the outer periphery of the rotary combustor.

3. The circumferentially movable air seal of claim 2, wherein the support plate is disposed adjacent a longitudinal margin of the arcuate plate.

4. The circumferentially air seal of claim 2, wherein the means for moving the arcuate shoe comprises a fluid operated cylinder.

5. The circumferentially movable air seal of claim 2, wherein the means for moving the arcuate shoe comprises an electric motor which cooperates with an mechanical device to vary the position of the shoe.

6. The movable air seal of claim 2, wherein the means for moving the arcuate shoe comprises a slot disposed in one of said arcuate plates and the other arcuate plate having a hole and a fastener fitting the slot and hole which cooperate to allow the first arcuate plate to move along an arcuate path.

* * * * *